US009540715B2

(12) United States Patent
Zimmermann et al.

(10) Patent No.: US 9,540,715 B2
(45) Date of Patent: Jan. 10, 2017

(54) CERMET POWDER

(75) Inventors: Stefan Zimmermann, Bad Saeckingen (DE); Benno Gries, Wolfenbuettel (DE)

(73) Assignee: H. C. STARCK GMBH, Goslar (DE)

( * ) Notice: Subject to any disclaimer, the term of this patent is extended or adjusted under 35 U.S.C. 154(b) by 230 days.

(21) Appl. No.: 14/342,538

(22) PCT Filed: Sep. 4, 2012

(86) PCT No.: PCT/EP2012/067210

§ 371 (c)(1),
(2), (4) Date: Mar. 4, 2014

(87) PCT Pub. No.: WO2013/034544

PCT Pub. Date: Mar. 14, 2013

(65) Prior Publication Data

US 2014/0234548 A1 Aug. 21, 2014

Related U.S. Application Data

(60) Provisional application No. 61/531,136, filed on Sep. 6, 2011.

(30) Foreign Application Priority Data

Sep. 6, 2011 (DE) ..... 10 2011 112 435

(51) Int. Cl.

| | |
|---|---|
| ***C22C 29/02*** | (2006.01) |
| ***C22C 29/06*** | (2006.01) |
| ***B22F 9/04*** | (2006.01) |
| ***B22F 9/08*** | (2006.01) |
| ***C22C 1/05*** | (2006.01) |
| ***C22C 19/03*** | (2006.01) |
| ***C22C 19/05*** | (2006.01) |
| ***C22C 29/08*** | (2006.01) |
| ***C23C 4/04*** | (2006.01) |
| ***C23C 4/06*** | (2016.01) |
| ***C22C 30/00*** | (2006.01) |
| ***C22C 38/42*** | (2006.01) |
| ***C22C 38/44*** | (2006.01) |
| ***B22F 1/00*** | (2006.01) |

(52) U.S. Cl.

CPC ..... *C22C 29/06* (2013.01); *B22F 1/0003* (2013.01); *B22F 9/04* (2013.01); *B22F 9/082* (2013.01); *C22C 1/051* (2013.01); *C22C 19/03* (2013.01); *C22C 19/052* (2013.01); *C22C 19/055* (2013.01); *C22C 29/067* (2013.01); *C22C 29/08* (2013.01); *C22C 30/00* (2013.01); *C22C 38/42* (2013.01); *C22C 38/44* (2013.01); *C23C 4/04* (2013.01); *C23C 4/06* (2013.01)

(58) Field of Classification Search
None
See application file for complete search history.

(56) References Cited

U.S. PATENT DOCUMENTS

| | | | | |
|---|---|---|---|---|
| 2,777,766 | A * | 1/1957 | Binder | C22C 19/055 420/582 |
| 4,981,646 | A * | 1/1991 | Culling | C22C 38/44 420/582 |
| 2003/0180565 | A1* | 9/2003 | Herbst-Dederichs | C22C 1/1084 428/553 |
| 2007/0102075 | A1* | 5/2007 | Mannan | C22C 19/05 148/707 |
| 2008/0145649 | A1* | 6/2008 | Mannem | C10M 111/00 428/336 |
| 2009/0283331 | A1 | 11/2009 | Heath | |
| 2010/0009089 | A1 | 1/2010 | Junod et al. | |
| 2010/0047622 | A1 | 2/2010 | Fischer et al. | |

FOREIGN PATENT DOCUMENTS

| | | | | |
|---|---|---|---|---|
| DE | 30 15 709 | A1 | 10/1981 | |
| DE | 3015709 | A1 * | 10/1981 | C22C 29/067 |
| DE | EP 1788104 | A1 * | 5/2007 | B22F 3/115 |
| DE | EP 1857204 | A1 * | 11/2007 | C01B 31/34 |
| DE | 10 2006 045 481 | B3 | 3/2008 | |
| EP | 1 788 104 | A1 | 5/2007 | |
| EP | 1 857 204 | A1 | 11/2007 | |

OTHER PUBLICATIONS

ASTM G 65-04: "Standard Test Method for Measuring Abrasion Using the Dry Sand/Rubber Wheel Apparatus", ASTM International, pp. 1-12 (Nov. 2004).

ASTM C 1070-01: "Standard Test Method for Determining Particle Size Distribution of Alumina or Quartz by Laser Light Scattering", ASTM International, pp. 1-3 (Nov. 2001).

ASTM B 117-07a: "Standard Practice for Operating Salt Spray (FOG) Apparatus", ASTM International, pp. 1-10 (Jan. 2008).

ASTM G 32-98: "Standard Test Method for Cavitation Erosion Using Vibratory Apparatus", ASTM International, pp. 1-14 (Dec. 1998).

* cited by examiner

*Primary Examiner* — Jessee Roe
*Assistant Examiner* — Ngoclan T Mai
(74) *Attorney, Agent, or Firm* — Norman B. Thot

(57) ABSTRACT

A cermet powder includes a) from 50 to 90 wt-% of at least one hard material, and b) from 10 to 50 wt-% of a matrix metal composition. The wt.-% for a) and b) are based on a total weight of the cermet powder. The matrix metal composition comprises i) from 40 to 75 wt-% of iron and nickel, ii) from 18 to 35 wt-% of chromium, iii) from 3 to 20 wt.-% of molybdenum, and iv) from 0.5 to 4 wt-% of copper. The wt-% for i) to iv) are based in each case on a total weight of the matrix metal composition. A weight ratio of iron to nickel is from 3:1 to 1:3.

16 Claims, No Drawings

CERMET POWDER

CROSS REFERENCE TO PRIOR APPLICATIONS

This application is a U.S. National Phase application under 35 U.S.C. §371 of International Application No. PCT/EP2012/067210, filed on Sep. 4, 2012 and which claims benefit to German Patent Application No. 10 2011 112 435.0 filed on Sep. 6, 2011, and to U.S. Provisional Patent Application No. 61/531,136, filed on Sep. 6, 2011. The entire disclosures of said applications are incorporated by reference herein. The International Application was published in German on Mar. 14, 2013 as WO 2013/034544 A1 under PCT Article 21(2).

FIELD

The present invention relates to cermet powder, a process for producing a cermet powder, and to the use of the cermet powders as a thermal spraying powder for surface coating. The present invention further relates to a process for producing a coated component comprising the production of a coating via thermal spraying of the cermet powder, and also a coated component which is obtainable according to the process.

BACKGROUND

Thermal spraying powders are used for producing coatings on substrates. Pulverulent particles are thereby introduced into a combustion or plasma flame directed onto the (mostly metallic) substrate which is to be coated. The particles melt in the flame, entirely or to some extent, and impact the substrate, where they solidify and, in the form of solidified "splats", form the coating. Thermal spraying can produce coatings up to a layer thickness of a number of mm. A frequent application of thermal spraying powders is the production of antiwear layers. Thermal spraying powders typically involve a subgroup of cermet powders which firstly comprise a hard material, most frequently carbides, such as tungsten carbides, chromium carbides, and molybdenum carbides, and secondly comprise a matrix composed of metals, for example, cobalt, nickel, and alloys of these with chromium, or else less frequently comprise iron-containing alloys. Thermal spraying powders and spray layers produced therefrom are therefore composite materials.

Coatings, like bulk materials, have empirically determinable properties. Among these are hardness (for example, Vickers, Brinell, Rockwell and Knoop hardness), wear resistance (for example, ASTM G65), cavitation resistance, and also corrosion performance in various media. Corrosion resistance is increasingly important during selection of spraying materials since many antiwear layers must exhibit dependable stability under acidic conditions in chemically aggressive environments (examples being use in the oil and gas industry, paper industry, chemicals industry, the food-and-drink industry, and the pharmaceutical industry, often with the exclusion of oxygen). This applies by way of example to displaceable parts of valves and to piston rods when acidic mineral oil or natural gas are conveyed in the presence of chlorides or seawater. There are also many applications in the food-and-drink industry, and also the chemicals industry, where wear and corrosion exert negative synergy and thus reduce the lifetime of antiwear coatings.

The corrosion of spray layers in acidic liquids and in the presence of chlorides takes place in accordance with the principle known to apply to cemented hard materials: the matrix alloy is attacked, and ions of the matrix metals are thus liberated. This provides access to the hard materials of the spray layer, and ablation of the spray layer takes place. When tribological wear is superposed, there is then a negative synergy from wear and corrosion. Corrosion performance is further reduced by the fact that contact corrosion can occur between the hard materials and the matrix, the matrix therefore being more susceptible to corrosion in the composite material than it would be alone. This is equally observed in cemented hard materials.

Various materials have become established as thermal spraying powders for producing spray layers for the abovementioned applications, examples including WC—CoCr 86/10/4 or WC—CoNiCr 86/9/1/4, WC—Cr3C2-Ni and Cr3C2-NiCr. A feature shared by all of the abovementioned is that they comprise Cr in the matrix since this ensures corrosion-resistance.

Another material is WC—NiMoCrFeCo 85/15 which is obtainable commercially in the form of thermal spraying powder (Amperit® 529 from H. C. Starck GmbH, D). Its matrix is composed of an alloy similar to Hastelloy® C. Although Hastelloy® C is used successfully in acidic media, this alloy lacks wear resistance. However, it exhibits poorer properties as a matrix alloy in a composite "spraying powder" or "spray layer" material.

Analogous considerations apply to the chromium carbide-NiCr (80/20) materials available on the market. The good acid resistance of NiCr 80/20 cannot be transferred to the thermal spraying powder with chromium carbides or to the spray layer produced therefrom.

Fe-based matrix alloys, for example, those derived from austenitic stainless steels such as 316L, or based on FeCrAl 70/20/10 as described in DE 10 2006 045 481 B3, fail in an acidic environment at low pH.

When any of the abovementioned materials in the form of compacted spray powder is exposed to hydrochloric acid, sulfuric acid, or citric acid, it exhibits weakness in at least one of these media, or a weaknesses in mechanical properties.

SUMMARY

An aspect of the present invention is to provide a cermet powder which is suitable as a thermal spray powder and which, in all three media (hydrochloric acid, sulfuric acid, and citric acid) provides stable coatings, without serious sacrifices in the mechanical properties of wear resistance and cavitation resistance, or in stability in the presence of chloride.

In an embodiment, the present invention provides a cermet powder which includes a) from 50 to 90 wt-% of at least one hard material, and b) from 10 to 50 wt-% of a matrix metal composition. The wt.-% for a) and b) are based on a total weight of the cermet powder. The matrix metal composition comprises i) from 40 to 75 wt-% of iron and nickel, ii) from 18 to 35 wt-% of chromium, iii) from 3 to 20 wt.-% of molybdenum, and iv) from 0.5 to 4 wt-% of copper. The wt-% for i) to iv) are based in each case on a total weight of the matrix metal composition. A weight ratio of iron to nickel is from 3:1 to 1:3.

DETAILED DESCRIPTION

Corrosion resistance is determined here under practical conditions in the form of emissions of the matrix metals, rather than electrochemical methods, such as potentiograms, which cannot quantify service time under practical conditions.

It has now surprisingly been found that the abovementioned problems can be solved via a cermet powder comprising one or more hard materials and a specific matrix metal composition.

In an embodiment, the present invention provides a cermet powder comprising:

a) from 50 to 90% by weight of one or more hard materials; and b) from 10 to 50% by weight of a matrix metal composition, where the data by weight are based on the total weight of the cermet powder, characterized in that the matrix metal composition comprises:

i) from 40 to 75% by weight of iron and nickel, ii) from 18 to 35% by weight of chromium, iii) from 3 to 20% by weight of molybdenum, iv) from 0.5 to 4% by weight of copper, where the data by weight for the metals i) to iv) are based in each case on the total weight of the matrix metal composition, and where the ratio by weight of iron to nickel is in the range of from 3:1 to 1:3.

The cermet powders of the present invention have excellent suitability as thermal spray powders. These powders can be used for surface coating, for example, of metal substrates. The cermet powders of the present invention can, for example, be applied to a wide variety of components by thermal spraying processes, such as plasma spraying or high-velocity flame spraying (HVOF) or other flame spraying processes, arc spraying, laser spraying, or application welding, for example, the PTA process, the objective being to give the respective component the desired surface properties.

The cermet powders of the present invention comprise one or more hard materials in an amount of from 50 to 90% by weight, for example, in an amount of from 60 to 89% by weight, for example, from 70 to 88% by weight, based in each case on the total weight of the cermet powder. The cermet powders of the present invention can comprise typical hard materials. Examples can, for example, include metal carbides such as a hard material, for example, those selected from the group consisting of WC, $Cr_3C_2$, VC, TiC, $B_4C$, TiCN, SiC, TaC, NbC, $Mo_2C$, and mixtures thereof.

Preference is in particular given to the hard materials WC and/or $Cr_3C_2$.

The cermet powders of the present invention have a matrix metal composition which is present in an amount of from 10 to 50% by weight, for example, from 11 to 40% by weight, for example, from 12 to 30% by weight, based in each case on the total weight of the cermet powder. The matrix metal composition is a determining factor for the excellent properties of the cermet powders of the present invention.

In an embodiment, the present invention provides the use of a matrix composition comprising:

i) from 40 to 75% by weight of iron and nickel;

ii) from 18 to 35% by weight of chromium;

iii) from 3 to 20% by weight of molybdenum;

iv) from 0.5 to 4% by weight of copper;

where the data by weight for the metals i) to iv) are based in each case on the total weight of the matrix metal composition, and where the ratio by weight of iron to nickel is in the range of from 3:1 to 1:3, for producing a cermet powder.

In an embodiment of the present invention, the matrix metal composition can, for example, comprise, as an additional metal:

v) cobalt, for example, in an amount of up to 10% by weight, based on the total weight of the matrix metal composition.

In an embodiment of the present invention, the matrix metal composition can also comprise:

vi) modifiers, for example, selected from the group consisting of Al, Nb, Ti, Ta, V, Si, W, and any desired mixtures thereof.

The usual amount of the modifiers present is up to 5% by weight, based on the total weight of the matrix metal composition.

In an embodiment of the present invention, the matrix metal composition to be used in the present invention can consist essentially of the following components:

i) from 40 to 75% by weight of iron and nickel;

ii) from 18 to 35% by weight of chromium;

iii) from 3 to 20% by weight of molybdenum;

iv) from 0.5 to 4% by weight of copper;

v) optionally up to 10% by weight of cobalt;

vi) optionally up to 5% by weight of one or more modifiers;

where the data by weight for the metals i) to vi) are based in each case on the total weight of the matrix metal composition, and where the ratio by weight of iron to nickel is in the range of from 3:1 to 1:3.

Excellent properties can be achieved with a matrix metal composition which comprises from 15 to 50% by weight, for example, from 20 to 45% by weight, of iron.

In an embodiment of the present invention, the matrix metal composition comprises from 15 to 50% by weight, for example, from 20 to 45% by weight, of nickel.

The presence of chromium, molybdenum and copper in the matrix metal composition achieves the excellent properties of the cermet powder or of the surface coatings produced therefrom.

In an embodiment of the present invention, the matrix metal composition can, for example, comprise from 20 to 33% by weight, for example, from 20 to 31% by weight, of chromium.

In an embodiment of the present invention, the matrix metal composition can, for example, comprise from 4 to 15% by weight of molybdenum, for example, from 5 to 10% by weight of molybdenum.

The copper content is important, in particular together with the specific iron-nickel ratio, for the corrosion properties. Excellent corrosion results were achieved with a matrix metal composition comprising, for example, from 0.7 to 3% by weight, for example, from 0.9 to 2.0% by weight, of copper.

The ratio by weight of iron to nickel in the matrix composition likewise contributes to the corrosion-resistance of the cermet powder of the present invention.

In an embodiment of the present invention, the ratio by weight of iron to nickel in the matrix metal composition can, for example, be from 1:2 to 2:1, for example, from 1:1.5 to 1.5:1.

In an embodiment of the present invention, the cermet powders of the present invention can, for example, be used as thermal spray powders. Certain particle sizes have proven to be particularly suitable. In an embodiment of the present invention, the average particle size of the cermet powders of the present invention can, for example, be from 10 to 100 μm, determined by means of laser scattering according to ASTM C1070.

The present invention also provides a process for producing the cermet powder of the present invention.

In an embodiment, the present invention provides a process for producing a cermet powder comprising:

a) mixing or milling of one or more hard-material powders with a pulverulent matrix metal composition which comprises:
   i) from 40 to 75% by weight of iron and nickel,
   ii) from 18 to 35% by weight of chromium,
   iii) from 3 to 20% by weight of molybdenum,
   iv) from 0.5 to 4% by weight of copper,
   where the data by weight for the metals i) to iv) are based in each case on the total weight of the matrix metal composition, and where the ratio by weight of iron to nickel is in the range of from 3:1 to 1:3;
b) sintering the powder mixture; and
c) optionally pulverizing the mixture sintered in step b).

The mixing or milling in step a) of the process of the invention for producing cermet powder can, for example, take place via dispersion of the pulverulent hardness-imparting materials (hard materials), and also of the pulverulent matrix metal composition, in a liquid. In the case of milling, the dispersion is then milled in a milling step, for example, in a ball mill or in an atrittor.

In an embodiment of the present invention, the matrix metal composition can, for example, take the form of alloy powder.

In an embodiment, the process of the present invention for producing cermet powder can, for example, include mixing via a dispersion in a liquid, optionally followed by milling, followed, via removal of the liquid, by a granulation step, which can, for example, take place via spray drying. The spray granulate can then be classified and, in a thermal process step that follows, can be sintered so that the mechanical strength of the granulate is sufficient to restrict disintegration of the granulate during the thermal spraying process in a manner which allows reliable conduct of the thermal spraying process. The sintering of the powder mixture can, for example, take place under reduced pressure and/or in the presence of inert gases, for example, selected from the group consisting of hydrogen, argon, nitrogen and mixtures thereof, at any desired pressure.

When an inert gas that avoids oxidation is used, the sintering can also be carried out in the approximate region of atmospheric pressure. The sintering step usually provides a powder or a loose sintered cake which can be converted back to powder. The powders obtained are similar in size and appearance to the spray granulate. Agglomerated/sintered spray powders offer freedom in the selection of the components (for example, their contents and particle sizes), and, by virtue of their good flowability, have good metering properties in the spraying process. In an embodiment of the present invention, very fine-particle hardness-imparting materials, for example, with an average particle size below 20 μm, as determined by means of laser scattering according to ASTM C1070, can be used for the cermet powders of the present invention and for the purposes of the production process of the present invention for cermet powder. The use of such fine-particle hardness-imparting materials leads to very smooth wear surfaces, and this in turn leads to low coefficients of friction and to long service times.

Sintered/crushed cermet powders or, respectively, spray powders can be produced analogously, except that the powder components are not necessarily mixed wet in dispersion, but can instead be mixed dry, and are optionally tableted or compacted to give other moldings. The sintering step that follows takes place analogously, but compact, strong sintered structures are usually obtained, which require exposure to mechanical force for conversion back to powder form. In these instances, however, the resultant powders with average particle sizes from 10 to 100 μm are typically of irregular shape and are characterized by fractured surfaces. These thermal spray powders have markedly poorer flowability, which can be disadvantageous for a constant application rate during thermal spraying, but is still practicable.

The cermet powders of the present invention, or the cermet powders obtainable according to the process of the present invention for producing cermet powder, can be used as a thermal spray powder. The present invention therefore further provides the use, as a thermal spray powder, of the cermet powders of the present invention or of the cermet powders obtainable via the process of the present invention for producing cermet powder.

The cermet powders of the present invention moreover have excellent suitability for surface coating, in particular, of metal substrates or of components.

The present invention therefore further provides the use, for surface coating purposes, of the cermet powders of the present invention or of the cermet powders obtainable via the process of the present invention for producing cermet powder. The surface coating can, for example, take place via a thermal spraying processes, for example, via plasma spraying or high-velocity flame spraying or other flame spraying processes, or arc spraying, or laser spraying, or application welding.

The cermet powders of the present invention or cermet powders obtainable via the present process of the present invention for producing cermet powder impart excellent properties to the components coated therewith, in particular, in respect of protection from wear under corrosive environmental conditions, for example, at pH below 7 and in the presence of any chloride ions that may be present.

The present invention therefore further provides a process for producing a coated component, the process comprising the application of a coating via thermal spraying of a cermet powder of the present invention or of a cermet powder obtainable via the process of the present invention for producing cermet powder.

The present invention further provides a coated component obtainable by the production process of the present invention. The component coated in the present invention can be used for protection from wear under corrosive environmental conditions, for example, at pH below 7, and in the presence of any chloride ions that may be present.

In an embodiment of the present invention, the coated component can, for example, be a part of an apparatus which comes into contact with media which comprise acids and/or which comprise chloride ions. By way of example, coated components of the present invention can be displaceable parts of valves or are piston rods.

The examples below illustrate the present invention without any resultant restriction of the present invention thereto.

Example 1

Comparative Example

Spray powders with compositions as set forth in Table 1 were compacted for 10 min at 1000° C. to give compact moldings with identical specific surface area, by means of hot pressing. The peripheral layers were smoothed by means of abrasive SiC paper. The cylindrical moldings were then exposed for 28 days to 500 ml of the media (1N hydrochloric acid, 1N sulfuric acid, and 1N citric acid—the latter corresponding to ⅓ mol/l) at 20° C. with air ingress. 180 ml were then removed, and the content of the elements of which the matrix was composed was determined.

The mechanical properties wear resistance and cavitation resistance were determined on sprayed layers. The sprayed layers were also subjected to the ASTM B117 salt-spray test, and the change was recorded after 1000 hours.

Coatings made of the spray powders were also produced on ST37 structural steel and on V4A stainless steel. A JP5000 HVOF burner was used for this purpose. The data in Table 1 are in percent by weight.

TABLE 1

| Prior-Art Spray Powders | | | | | | | |
|---|---|---|---|---|---|---|---|
| | No. 1 | No. 2 | No. 3 | No. 4 | No. 5 | No. 6 | No. 7 |
| WC (%) | 86 | — | 73 | 85 | 85 | 70 | 85 |
| $Cr_3C_2$(%) | — | 75 | 20 | — | — | — | — |
| Matrix (%) | 14 | 25 | 7 | 15 | 15 | 30 | 15 |
| Fe(%) | — | — | — | 6 | 63.3 | | 70 |
| Co(%) | 71 | — | — | 5 | — | | — |
| Ni (%) | — | 80 | 100 | 57 | 14 | 67 | — |
| Cr (%) | 29 | 20 | — | 16 | 18 | 20 | 20 |
| Al (%) | — | — | — | — | — | — | 10 |
| Nb (%) | — | — | — | — | — | 4 | — |
| Mo (%) | — | — | — | 16 | 2.7 | 9 | — |
| Cu (%) | — | — | — | — | — | — | — |
| Matrix emission (mg/180 ml, 28 days, 1N HCl) | 2283 | 5684 | 420 | 3269 | 2510 | 4360 | 3083 |
| Matrix emission (mg/180 ml, 28 days, 1N H2SO4) | 2366 | 5151 | 1835 | 2202 | 2620 | 2570 | 3222 |
| Matrix emission (mg/180 ml, 28 days, 1N citric acid) | 316 | 2486 | 11 | 125 | 1352 | 106 | 3141 |
| Properties of sprayed layer: | | | | | | | |
| Wear (ASTM G65-04, mg) | 20 | 41 | 15 | 41 | 33 | 41 | 23 |
| Cavitation wear (mg/h) according to ASTM G32 on level coating | 5 | 5 | 7 | 5 | 10 | 7 | 5 |
| Change in salt-spray test according to ASTM B117 (1000 h) | disc. | none | none | none | disc. | none | none |

"disc." means "discoloration".

The data by weight for "Fe (%)" to "Cu (%)" are based on the total weight of the matrix composition. The total content of matrix is stated in the "Matrix (%)" row, and is based on the total weight of the spray powder. The % data for the carbides are based on the total weight of the spray powder. In the spray powders of Nos. 4 to 7, the matrix took the form of an alloy since a corresponding alloy powder was used to produce the spray powder. No. 7 corresponds to a preferred embodiment described in DE 10 2006 045 481 B3.

It is clear from the results that no known material performs adequately in all respects. WC—Cr3C2-Ni 83/20/7 (No. 3) is the only material with adequate resistance to hydrochloric acid and citric acid, but not to sulfuric acid. The resistance of all of the spray powders of Nos. 1-7 to sulfuric acid is generally poor.

Spray powder No. 4 with a matrix alloy similar to Hastelloy®C, and No. 6 also have good mechanical properties and good resistance to citric acid, but are not resistant to mineral acids.

Spray powder No. 5 with 316 L stainless steel has very low corrosion-resistance and exhibits unacceptable discoloration in the salt-spray test.

Example 2

Partly Inventive, as Indicated by "*"

Moldings and sprayed layers were produced analogous to Example 1. The powders according to Nos. 8 and 9 used two alloy powders of identical nominal composition but from different production processes (spraying of the alloy from the melt and cooling of the resultant melt droplets by means of water and, respectively, argon injected through a nozzle). No. 10 comprises, as a matrix, an FeNi 50/50 alloy powder, and also a chromium metal powder used as further component of the matrix. It can therefore be assumed that, in the agglomerated/sintered spray powder, the matrix was not completely and uniformly alloyed with Cr. The data in Table 2 are in percent by weight.

TABLE 2

| Spray Powders | | | |
|---|---|---|---|
| | No. 8* | No. 9* | No. 10 |
| WC (%) | 85 | 85 | 87.5 |
| Cr3C2 (%) | — | — | — |
| Matrix (%) | 15 | 15 | 12.5 |
| Fe (%) | 31 | 31 | 36 |
| Co(%) | — | — | — |
| Ni (%) | 31 | 31 | 36 |
| Cr (%) | 27 | 27 | 28 |

TABLE 2-continued

| Spray Powders | No. 8* | No. 9* | No. 10 |
|---|---|---|---|
| Al (%) | — | — | — |
| Nb(%) | — | — | — |
| Mo(%) | 6.5 | 6.5 | — |
| Cu (%) | 1.3 | 1.3 | — |
| Matrix emission (mg/180 ml, 28 days, 1N HCl) | 216 | 151 | 1740 |
| Matrix emission (mg/180 ml, 28 days, 1N $H_2SO_4$) | 151 | 92 | 1141 |
| Matrix emission (mg/180 ml, 28 days, 1N citric acid) | 68 | 61 | 608 |
| Properties of sprayed layer | | | |
| Wear (ASTM G65-04, mg) | 26 | 26 | 15 |
| Cavitation wear (mg/h) | 6 | 5 | 8 |
| Change in salt-spray test | none | none | discoloration |

The data by weight for "Fe (%)" to "Cu (%)" are based on the total weight of the matrix composition. The total content of matrix is stated in the "Matrix (%)" row, and is based on the total weight of the spray powder. The % data for the carbides are based on the total weight of the spray powder.

The iron- and nickel-containing spray powders Nos. 8 to 10 surprisingly exhibit relatively good resistance to mineral acids in comparison with those having a matrix based on nickel, on cobalt, or indeed on iron. This is surprising to the extent that iron is substantially less inert than nickel. Even the incomplete alloy of the matrix with Cr in No. 10 gives better results in sulfuric acid than any of the powders of Example 1. It appears that FeNi alloys have better acid resistance than the range-endpoints Ni and Fe, and the acid resistance therefore appears to be dependent on the Fe:Ni ratio, as well as on the other elements present.

The acid resistance of the FeNi matrix is further improved in powders Nos. 8 and 9 by the chromium alloyed in the matrix here, and also by the additional materials Mo and Cu. Since, however, the high Mo contents in powders 4 and 6 do not lead to improved acid resistance, it must be concluded that, alongside the Fe/Ni ratio, the copper content is substantially concomitantly responsible for the good corrosion results.

Example 3

Comparative Example, Pure Matrix Alloys

TABLE 3

| Matrix Metal Composition | No. 11 (316L) | No. 12 (NiCr80/20) | No. 13 (NiCr50/50) |
|---|---|---|---|
| Fe (%) | 68 | — | — |
| Co (%) | — | — | — |
| Ni (%) | 13 | 80 | 50 |
| Cr (%) | 17 | 20 | 50 |
| Al (%) | — | — | — |
| Nb (%) | — | — | — |
| Mo (%) | 2 | — | — |
| Cu (%) | — | — | — |
| Matrix emission (mg/180 ml, 28 days, 1N HCl) | 948 | 115 | 256 |
| Matrix emission (mg/180 ml, 28 days, 1N H2SO4) | 944 | 110 | 131 |

TABLE 3-continued

| Matrix Metal Composition | No. 11 (316L) | No. 12 (NiCr80/20) | No. 13 (NiCr50/50) |
|---|---|---|---|
| Matrix emission (mg/180 ml, 28 days, 1N citric acid) | 25 | 1 | 35 |

These results show that the pure matrix alloys performs substantially better in relation to corrosion than when they are used as matrix in the thermal spray powder. It must be assumed that contact corrosion between the matrix on the one hand and the hard material on the other hand is responsible for the poor performance of the thermal spray powders.

The pure matrix alloys in the form of spray powders have no wear resistance because of the absence of hard materials.

Nos. 8 and 9 according to the present invention are successful in achieving the acid resistance of pure NiCr 80/20 combined with the wear resistance of commercially available spray materials, as described in Examples 1 to 3.

The present invention is not limited to embodiments described herein; reference should be had to the appended claims.

What is claimed is:

1. A sintered cermet powder comprising:

a) from 50 to 90 wt-% of at least one hard material; and b) from 10 to 50 wt-% of a matrix metal composition, the wt.-% for a) and b) being based on a total weight of the cermet powder, the matrix metal composition comprising:

i) from 40 to 75 wt-% of iron and nickel, ii) from 18 to 35 wt-% of chromium, iii) from 3 to 20 wt.-% of molybdenum, and iv) from 0.5 to 4 wt-% of copper, the wt-% for i) to iv) being based in each case on a total weight of the matrix metal composition, and a weight ratio of iron to nickel being from 3:1 to 1:3, wherein the sintered cermet powder is produced by a process comprising the steps of:

mixing or milling the at least one hard material powder with the matrix metal composition which is provided as a powder so as to obtain a powder mixture, and sintering the powder mixture so as to obtain the sintered cermet powder mixture.

2. The sintered cermet powder as recited in claim 1, wherein the matrix metal composition further comprises v) cobalt.

3. The sintered cermet powder as recited in claim 2, wherein the cobalt is present in an amount of up to 10 wt-% based on the total weight of the matrix metal composition.

4. The sintered cermet powder as recited in claim 1, wherein the matrix metal composition further comprises vi) a modifier.

5. The sintered cermet powder as recited in claim 4, wherein the modifier is selected from Al, Nb, Ti, Ta, V, Si, W and mixtures thereof.

6. The sintered cermet powder as recited in claim 4, wherein the modifier is present in an amount of up to 5 wt-% based on the total weight of the matrix metal composition.

7. The sintered cermet powder as recited in claim 1, wherein the matrix metal composition consists essentially of:

i) from 40 to 75 wt-% of iron and nickel;

ii) from 18 to 35 wt-% of chromium;

iii) from 3 to 20 wt-% of molybdenum;

iv) from 0.5 to 4 wt-% of copper;

v) from 0.0 to 10 wt-% of cobalt; and vi) from 0.0 to 5 wt-% of at least one modifier;

the wt-% for i) to vi) being based in each case on the total weight of the matrix metal composition, and the weight ratio of iron to nickel being from 3:1 to 1:3.

8. The sintered cermet powder as recited in claim 1, wherein the matrix metal composition comprises from 15 to 50 wt-% of iron.

9. The sintered cermet powder as recited in claim 1, wherein the matrix metal composition comprises from 15 to 50 wt-% of nickel.

10. The sintered cermet powder as recited in claim 1, wherein the matrix metal composition comprises from 20 to 33 wt-% of chromium.

11. The sintered cermet powder as recited in claim 1, wherein the matrix metal composition comprises from 4 to 15 wt-% of molybdenum.

12. The sintered cermet powder as recited in claim 1, wherein the matrix metal composition comprises from 0.7 to 3 wt-% of copper.

13. The sintered cermet powder as recited in claim 1, wherein the weight ratio of iron to nickel in the matrix metal composition is from 1:2 to 2:1.

14. The sinteed cermet powder as recited in claim 1, wherein the at least one hard material is a metal carbide.

15. The sintered cermet powder as recited in claim 14, wherein the metal carbide is selected from WC, $Cr_3C_2$, VC, TiC, $B_4C$, TiCN, SiC, TaC, NbC, $Mo_2C$ and mixtures thereof.

16. The sintered cermet powder as recited in claim 1, wherein the cermet powder comprises an average particle size of from 10 to 100 μm as determined in accordance with ASTM C1070.

* * * * *